US005426953A

United States Patent [19]

Meckler

[11] Patent Number: 5,426,953

[45] Date of Patent: Jun. 27, 1995

[54] CO-SORPTION AIR DEHUMIDIFYING AND POLLUTANT REMOVAL SYSTEM

[76] Inventor: Milton Meckler, 930 20th St. #2, Santa Monica, Calif. 90403

[21] Appl. No.: 101,632

[22] Filed: Aug. 4, 1993

Related U.S. Application Data

[63] Continuation-in-part of Ser. No. 16,152, Feb. 5, 1993.

[51] Int. Cl.[6] ..... F24F 7/00

[52] U.S. Cl. ..... 62/271; 55/231; 55/259; 165/8

[58] Field of Search ..... 62/94, 271, 332; 55/212, 217, 226, 231, 242, 259; 165/3, 8, 104.21

[56] References Cited

U.S. PATENT DOCUMENTS

| | | | |
|---|---|---|---|
| 2,085,964 | 7/1937 | Fonda | 62/94 |
| 3,672,126 | 6/1972 | Goettle | 55/106 |
| 3,774,374 | 11/1973 | DuFour et al. | 55/316 |
| 3,844,737 | 10/1974 | Macriss et al. | 55/34 |
| 3,880,224 | 4/1975 | Weil | 165/2 |
| 4,180,126 | 12/1979 | Rush et al. | 165/59 |
| 4,607,498 | 8/1986 | Dinh | 62/185 |
| 4,887,438 | 12/1989 | Meckler | 62/271 |
| 4,900,341 | 2/1990 | Csabai | 55/222 |
| 5,170,633 | 12/1992 | Kaplan | 62/94 |
| 5,191,771 | 3/1993 | Meckler | 62/271 |
| 5,212,959 | 5/1993 | Tsimerman | 62/94 |

*Primary Examiner*—Henry A. Bennet
*Assistant Examiner*—William C. Doerrler
*Attorney, Agent, or Firm*—William H. Maxwell

[57] ABSTRACT

An air dehumidifying and air pollutant removal system adapted especially to desiccant wheel operation with downstream air filtering, and the discrete use of desiccants for the adsorption of gaseous pollutants as well as water vapor and both of which are desorped by regeneration, and downstream filter packs for the absorbtion of gasses and particulate matter collected thereby and desorbed for exhaust to atmosphere during off periods of building occupancy.

23 Claims, 2 Drawing Sheets

CO-SORPTION AIR DEHUMIDIFYING AND POLLUTANT REMOVAL SYSTEM

This is a Continuation In Part application from application Ser. No. 08/016,152 entitled POLYMER DESICCANT AND SYSTEM FOR DEHUMIDIFIED AIR CONDITIONING filed Feb. 5, 1993.

BACKGROUND OF THE INVENTION

Desiccant based air dehumidification offers the advantage of improving indoor air quality through the process of co-sorption of both moisture and the various gaseous pollutants common to incoming outside air OSA or mixed outdoor air and recirculated indoor return air RA. Additionally, desiccant dehumidification of air by solid desiccants captures and removes certain particulates from such air. This invention is particularly concerned with desiccant wheels and discriminate use of desiccants including molecular sieves, activated carbon, silica gel, polystyrene sulfonic acid lithium salt (PSSA-Li), alumina, zeolite, lithium chloride, etc. that will co-adsorb moisture and gaseous pollutants by adsorption.

Among gaseous pollutants known to be subject to co-adsorption are Volatile Organic Compounds VOCs which are detremental and harmful when concentrated, and among which are trichlorethane, toluene, benzene, formaldehyde, etc. Also, gaseous pollutants include radon, carbon dioxide and carbon monoxide. Particulate pollutants are respirable particles, for example those below 10 microns, and viable or living micro organisms that often propagate and grow in air conditioning ducts. The surface characteristics of solid desiccant used in dehumidifier wheels offer the properties necessary for water vapor and gaseous pollutant adsorption, and for volatile organic compounds VOCs as well.

Desiccant regeneration is effective within a wide range of temperatures from 130° to 300° F., it being an object of this invention to recover a large portion of this heat and thereby minimize heat loss to atmosphere in the exhaust of relief air RE.

Pollutant removal from both incoming outside air OSA and recirculated supply air SA is provided herein by both particulate filtration and by gas adsorption, the desiccant dehumidifier wheel as it is described herein is a gas adsorber that captures gasses and vapors, including Volatile Organic Compounds VOCs during the dehumidification phase, and discharges the same during the regeneration phase of dehumidifier operation. The particulate pollutants are removed by filter collection.

This invention deals with outside air OSA pollution as well as indoor air pollution generated by building materials, appliances, furnishings, and by human occupancy, all of which generates air pollution.

There is a wide variety of volatile chemicals that can be removed from the air being conditioned, for example, the presence of carbon dioxide is a known indication of building occupancy contamination, though it is not in itself dangerous, and it is known that building inhabitants emit gasses other than $CO_2$ (i.e. methane) which have high reduction potentials, there being a broad range of chemicals which pollute the air, especially Volatile Organic Compounds VOCs, as follows:

| | |
|---|---|
| Hydrogen Sulfide | $H_2S$ |
| Vinyl Chloride | $C_2HC_3CL$ |

-continued

| | |
|---|---|
| Methyl Ethyl Ketone | $C_4H_8O$ |
| Hydrogen | $H_2$ |
| Metheanol | $CH_4O$ |
| Gasoline | $C_xH_x$ (x is variable) |
| Formaldehyde | $CH_2O$ |
| Trichloroethylene | $C_2HCL_3$ |
| Acetone | $C_3H_6O$ |
| Ethanol | $C_2H_6O$ |
| Freon 22 | $CHCIF_2$ |
| Ammonia | $NH_3$ |

and others such as Freon 12, Propane, Methane, Methyl Chloride, Carbon Monoxide, Nitrogen Dioxide and Chlorine.

SUMMARY OF THE INVENTION

This dehumidifier system provides for the adsorption of gaseous pollutants and for the recovery of latent heat from the desiccant regeneration phase of the dehumification process that discharges said gaseous pollutants with the exhaust of relief air RE. Additionally, the incoming outside air OSA from which said gaseous pollutants are removed by adsorption is admixed with return air RA from the building interior and becomes supply air SA which is filtered before and/or after heat application or removal.

A feature of this invention is the withdrawal of heat from the incoming outside air OSA by heat pipe means that adds first stage heat into the relief air RE that is taken from the return air RA.

Another feature of this invention is the recovery of latent heat from the regeneration phase of the dehumidification process that adds second stage heat into the relief air RE.

Still another feature of this invention is the application of sufficient third stage heat into the relief air RE by means of an indirect or direct gas fired heater for efficient regeneration of the desiccant previously weakened by the dehumidifying phase of removing water vapor and gaseous pollutants VOCs from the incoming outside air OSA.

Still another feature of this invention is the final cleaning of both incoming air OSA and recirculated supply air SA by means of filtration that removes particulate matter, as will be described.

Still another feature and object of this invention is reactivation of downstream filter packs (carbon packs) by means of desorption, by humidifying the supply air SA and exhausting it to atmosphere during off periods of building occupancy.

The foregoing and various other objects and features of this invention will be apparent and fully understood from the following detailed description of the typical preferred form and application thereof, throughout which description reference is made to the accompanying drawings.

THE DRAWINGS

FIG. 1 is a longitudinal side elevation illustrating the system of the present invention, with the dehumidifier section D installed ahead of the power section 10 and filter section 11 that discharges through the air conditioner AC unit section 12.

Figure 6:
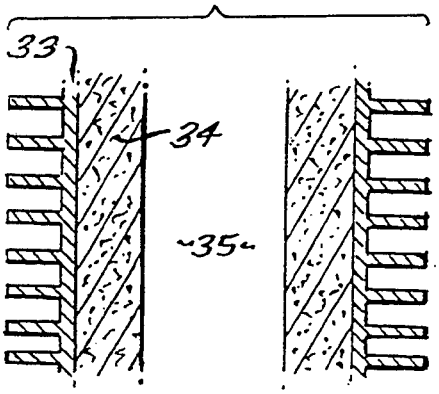

And, FIG. 6 is a sectional view showing the finned feature of the heat-pipe for efficient heat transfer.

PREFERRED EMBODIMENT

Figure 1:
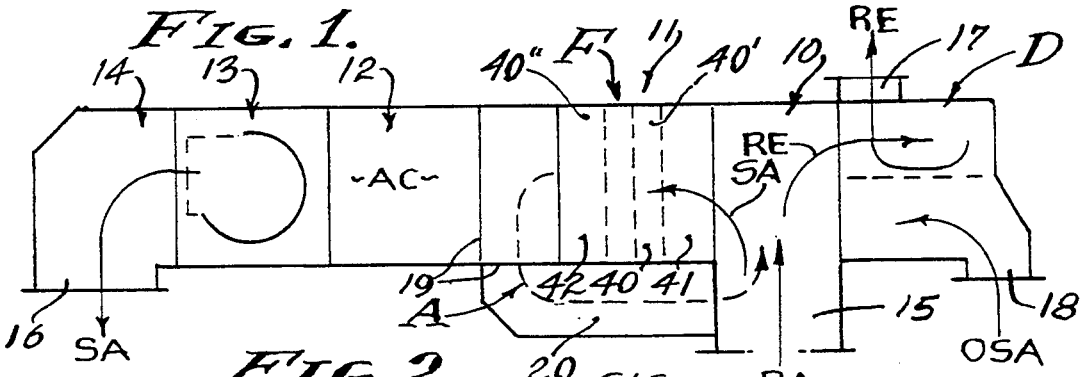
Figure 2:
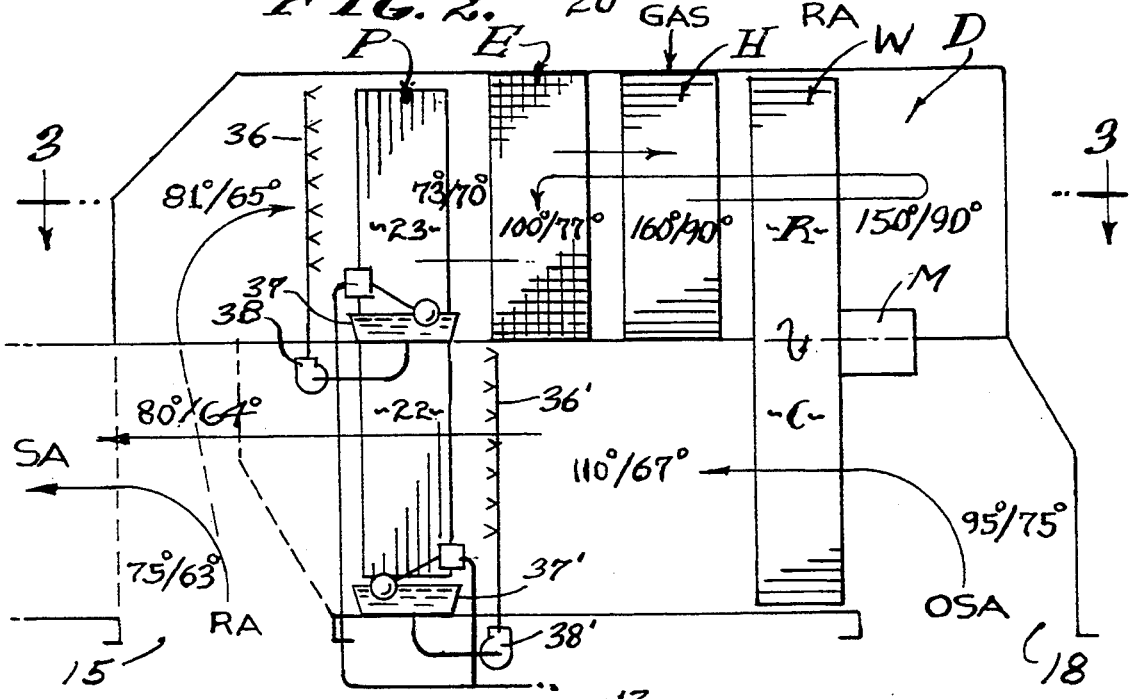
FIG. 2 is a longitudinal section through the dehumidifier section D shown in FIG. 1.
Figure 3:
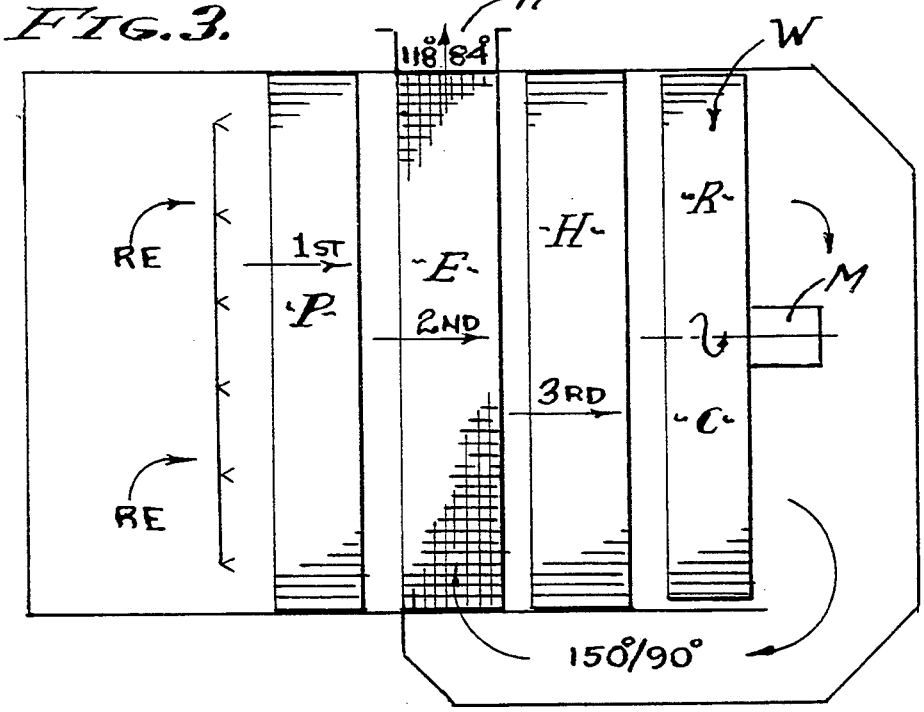
FIG. 3 is a plan section taken as indicated by line 3—3 on FIG. 2.
Figure 4:
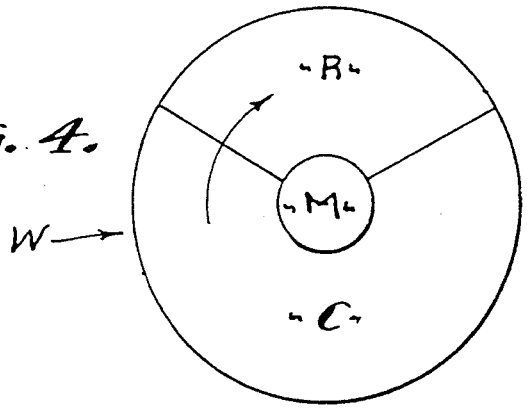
FIG. 4 is an illustration of a desiccant wheel as it is used herein, to show the movement and areas thereof applied to dehumidification and to regeneration (normal application).

Referring now to the drawings, FIG. 1 illustrates typical refrigeration air conditioning equipment comprised of a power return section 10, a filter section 11, an air conditioner AC unit or heat pump section 12, a blower section 13, and a diffuser and final filter section 14. The air conditioner AC unit and/or heat pump and machinery is not shown, all of which can be internal or external of the ducting shown. The power section 10 is preferably a blower section that includes means that separates return air RA into supply air SA and relief air RE. That is, one portion of the return air RA is conditioned interior air that is recirculated as supply air, and the other portion is diverted as relief air.

In accordance with this invention, the relief air RE is advantageously employed in a co-sorption process of a dehumidifier means D that simultaneously removes moisture and gaseous pollutants from the outside air OSA as it enters into the return air RA, while recovering latent sensible heat from the process of regeneraton of weakened desiccant as a result of dehumidifying the incoming outside air OSA. Thus, relief air RE is separated out of the return air RA, the balance of which is then mixed with outside air OSA to become supply air SA. The relief air RE recovers heat from the dehumidified and de-polluted outside air by means of a heat pipe P and recovery of waste heat from the regeneration section of the dehumidifier per se, and sufficient heat for regeneration of the desiccant is added as by means of a gas fired heater H prior to passing the pre heated relief air RE through the regeneration section of the dehumidifier. In practice, the dehumidifier is a desiccant wheel W.

A feature of this invention is the discharge of relief air RE after it is used in the desiccant regeneration process, and the replacement of this air by outside air OSA which is dehumidified as it enters into the system through the desiccant wheel W to commingle into the supply air SA while transferring latent and sensible heat through the heat pipe P and into the relief air RE that is used for desiccant regeneration. Thus, the temperature of incoming outside air OSA to the power return section 10 is less than the outside air temperature, and the discharge temperature of relief air is minimized. The sections 10–14 discharge supply air SA into a conditioned interior at temperature and humidity set by thermostats and humidistats (not shown). The downstream air conditioning equipment is state of the art, receiving dehumidified and de-polluted outside air delivered into a micro climate or a building occupancy structure, for example from a discharge duct 16 as conditioned supply air SA. The power return section 10 is in open communication with an intake duct 18 and receives the treated outside air OSA therefrom. The power return section 10 is characterized by a splitter or damper means (not shown) that separates a portion of the return air RA as relief air RE utilized in the dehumidifier means D and exhausted at 17 (see FIG. 1). Outside air OSA is inducted through an inlet duct 18.

In accordance with the co-sorption process of this invention , the desiccant wheel W is comprised of a pack of discriminately designed desiccant material for the adsorption and desorption of water vapor and selected pollutant gasses, vapors and volatile organic compounds carried by the incoming outside air OSA that has intimate contact therewith when passing through contacter section C. Such discriminately designed desiccant materials include known molecular sieves, activated carbon, silica gel, alumina, Millapore®, zeolite, lithium chloride, etc., which are selected herein individually and/or combined for the adsorption of certain selected gases, vapors and volatile organic compounds, or a multiplicity thereof.

The co-adsorption desiccant wheel W processes incoming outside air OSA by means of adsorption that removes moisture and gaseous pollutants, weakening the desiccant. Said desiccant is then regenerated by heated relief air RE and the ad-sorped water vapor and selected pollutant gas or gasses de-sorped and discharged to atmosphere at 17. Return air RA enters the power return section 10 and commingles with incomming outside air OSA.

In accordance with this invention, there is a dehumidification phase of adsorption of water vapor and gaseous contaminants from the outside air OSA flowing therethrough, there is a heat-pipe means P for first stage heating of relief air RE by removing heat from the outside air OSA entering through the dehumidifier wheel W, and there is a heat exchanger means E for second stage heating of the relief air RE in the process of exhausting it to atmosphere through the duct 17. And ultimately, the relief air RE is finally heated by third stage heating for the required effecive regeneration of the previously weakened desiccant. Accordingly, the heat absorber section 22 of the heat-pipe means P follows the dehumidifier contactor section C in the flow of outside air OSA from the entry at 18 to the power return section 10 through duct 15. And, the heat rejecter section 23 of the heat-pipe means P provides the first stage heating of relief air RE that preceeds second and third stage heating, as will be described.

The dehumidifier contactor section C heats the incoming outside air OSA as a result of the desiccant adsorption of water vapor and gaseous contaminants, following which said outside air is cooled by the heat absorber section 22 of the heat-pipe means P. The heat pipe means P cools the incoming outside air OSA discharged by the dehumidifier contacter section C, by absorbing heat therefrom at its heat absorber section 22, as it heats the outgoing relief air RE by rejecting heat at its heat rejecter section 23. Accordingly, the heat absorber section 22 is in the duct 18 following contacter C while the heat rejecter section 23 is in the duct 17 preceeding the regenerator section R. The heat-pipe P is characterized by a hot end for absorbtion of heat and by a cold end for rejection of heat. In other words, there is a "heat in" and a "heat out" end, for the normal cooling summer mode, which is inherently reversed for the normal winter heating mode.

In carrying out this invention, the cold "heat out" rejecter section 23 is placed in the relief air regeneration duct 17, and the hot "heat in" absorber section 22 is placed in the outside air OSA inlet duct 18. A feature of this invention is that the heat absorber section 22 follows the dehumidifier contacter section C, while the rejecter section 23 is a first stage heater that preceeds the regenerater section R. Accordingly, there is a heat transfer function that occurs between and from duct 18 to duct 17, so as to reduce the inlet air temperature after dehumidification by the desiccant, and to increase the relief air RE temperature prior to its employment in regenerating the desiccant. In practice, transfer of heat energy from the incoming column of OSA air to the outgoing column of RE air is by means of a multiplicity of heat-pipe tubes, the cold end sections 23 in the form of heat dissipaters placed in the duct 17 ahead of the regenerater means and the hot end sections 22 in the form of heat absorbers placed in the duct 18 following the dehumidifier means contactor C.

Figure 5:
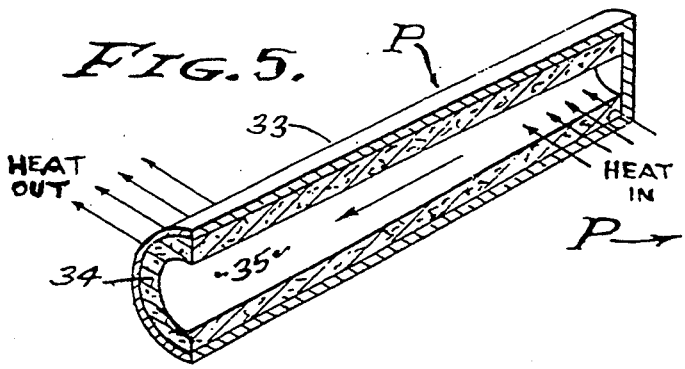
FIG. 5 is a perspective fragmentary section of a heat-pipe configuration as it is employed throughout this disclosure.

In accordance with this invention, the heat-pipes P are lengths of heat conductive tubing 33 sealed at their opposite ends, having interior fitting tubular wicks 34, and charged with a fluid refrigerant 35, a temperature responsive liquid-to-gas (see FIGS. 5 and 6). A temperature differential between the ends of each pipe causes the fluid refrigerant to migrate in its liquid state by capillary action to the warmer end where evaporation to its gaseous state takes place and thereby absorbs heat. The resultant gaseous refrigerant vapor then returns through the hollow of the tube, where it gives up the heat carried thereby, by condensing into the wick in order to repeat the cycle. The heat transfer process is efficient, since the heat pipes are sealed and have no moving parts, and therefore require little or no attention. The heat-pipes are finned for most efficient heat energy transfer.

In accordance with this invention, control of the heat-pipe means P involves evaporative means cooling of either the heat rejecter section 23 or the heat absorber section 22 thereof as and when required to increase the cooling and heat transfer effect thereof. As shown, a spray bar 36 supplied with an evaporative liquid such as water from a sump 37 by a recirculating pump 38 wets the finned air contacting exterior of the heat rejector section 23 of the heat-pipe. And, a spray bar 36' supplied with an evaporative liquid such as water from a sump 37' by a recirculating pump 38' wets the finned air contacting exterior of the heat absorber section 22 of the heat-pipe. In practice, the evaporative liquid is cold make-up water that has a sensible cooling effect as well as an evaporative cooling effect. Thermostats and/or humidistats (not shown) sense temperature and humidity as control means that determines the cooling and/or heat transfer functions of the heat-pipe means P.

Referring now to the three stages of relief air RE heating in a normal summer time cooling and dehumidification mode, the building space return air RA enters the power return section 10, for example at 75° db/63° wbF. The power return section 10 also receives dehumidified outside air OSA, for example at 110° db/67° wbF that is commingled with return air RA by damper means (not shown) that removes a portion of return air RA as relief air RE, for example at 81° db, 65° wbF. The outside air OSA enters through duct 18, for example at 95° db/75° wbF. This substantial change in dry bulb and wet bulb temperatures is an example of "Deep Drying", whereby the dehumidified outside air OSA is extremely dry so as to be advantageously humidified at the "heat-in" ends 22 of the heat-pipe means P by means of evaporative cooling through the application of water by the spray bar 36' hereinabove described, to reduce the temperature of the dehumidified outside air OSA entering into the power return section 10 to commingle with the return air RA for discharge into the filter section 11, for example at 80° db/64° wbF.

Referring now to the heat-pipe means P and to the first stage of relief air RE heating, the relief air RE entering through duct 17 at 81° /65° F. passes over the "heat-out" ends 23 of heat-pipe means P subject to evaporative cooling by spray bar 36 hereinabove described to increase the "heat-out" to "heat-in" temperature differential. Accordingly, the dry bulb temperature decreases to 73° dbF while the wet bulb temperature increases to 70° wbF, due to the evaporation effect. However, the "heat-out" to "heat-in" temperature differential ensures efficiency of the heat-pipe function.

Referring now to the heat exchanger means E and to the second stage of relief air RE heating, the residual heat remaining in the relief air RE after regenerating the weakened desiccant by passing it through the wheel section R is recovered before exhausting it from duct 17. In practice and for example, the residual heat or temperature of the relief air RE after regeneration by passing it through the regenerator section R is for example 150° $^{db}$/90° $^{wb}$F, and approximately 80% of the sensible heat is recovered by the means E in the form of a compact heat exchanger. The heat exchanger of means E is placed in the 1st stage pre-heated relief air RE downstream from the first stage heating by the heat-pipe means P and passes a waste column of relief air RE therethrough and discharged from the duct 17, for example at 118° db84° wbF. In practice, the heat exchanger is of plate or tube type construction that isolates the heated column and waste columns of relief air RE for heat transfer therebetween by means of conduction from the latter to the former. That is, the waste heat column provides the second stage heating to the pre-heated column of relief air RE, for example to raise it to 110° db/77° wbF. As a result of sensible heat transfer in the heat exchanger E the used relief air RE is exhausted from duct 17, for example at 118° db/84° wbF.

Referring now to the final third stage heating of relief air RE, an efficient desiccant regeneration requires a relief air temperature of 160° db/90° wbF. Accordingly, the heating means H is preferably an indirect or direct gas fired heater controlled by thermostat means (not shown) to raise relief air RE temperature as required, to enter through the regenerater section R at the required stated temperature, in which case it will exhaust therethrough, for example at 150° db/90° wbF. In practice, greater dehumidification referred to as "Deep Drying" requires commensurately greater heat application by heated relief air RE passing through the regenerater section R of the desiccant wheel W, for example within a range of 130° to 300° F. It is to be understood that the first, second and third stage temperatures and said exhaust temperature vary dependent upon the work load and different ambient conditions.

The filter section 11 removes the remaining gaseous and particulate pollutants that are carried by the supply air SA and added outside air OSA, and is shown herein as a gas filter means comprised of a pre-filter 41, and intermediate gas apsorbent filter 40, and an after filter 42. Either one or all of the filters 40–42 are employed in combination with the co-sorption system hereinabove described, to finish the removal of gaseous pollutants and particulate matter. The pre-filter 41 is constructed to remove particulate matter finer than that removed by the upstream process. The after filter 42 is constructed to remove particulate matter that is finer yet. The degree of particulate filtration can be varied as required, and the intermediate gas filter 40 is, for example, an activated carbon pack, or a potassium permanganate pack, or preferably a combinaton thereof capable of passing the air while absorbing the gaseous and particulate contaminants therefrom.

In accordance with this invention, the filter section 11 is provided for pollutant gas removal, and for removal of fine particulate matter as well. In practice, an activated carbon pack of pellets is basic, as it is conducive to relatively free flow of air and presents an extremely large collection area for its bulk weight, for example 1 lb/76,000,000 square feet. Filtration is by means of the condensation of pollutant gasses upon said surface area in the carbon pores that absorb and retain the film of liquid that is formed together with fine particulate matter carried and/or dissolved therein. Among the matter carried by polluted gasses such as carbon dioxides ($CO_2$) are tobacco smoke, smog, food odors, animal odors as well as human odors, and structural and furnishing odors. Such a filter pack will saturate to about 50% of its weight with gasses and particulate matter, after which replacement and/or reactivation is required for efficient performance.

Potassium permanganate ($KMnO_4$) is a widely used filtering material for removal of gasses and particulates, but has the disadvantage of permitting some pollutants to pass therethrough due to oxidation of volatile organic compounds VOCs releasing undesirable by-products eg: aldehydes, ozone, etc. which can result in secondary indoor air quality problems. However, since activated carbon will capture pollutants such as ozone, formaldehydes and other gaseous by-products of oxidation, a preferred form of filter pack 40 is comprised of a potassium permanganate pack 40' for removal of VOCs followed by an activated carbon pack 40'' for further efficient removal of aldehydes, VOCs, ozone and others.

In accordance with this invention, downstream filter packs such as the filter pack 40 shown herein are reactivated when they become saturated and/or partially saturated. This is made possible by the desorption capabilities of selected filtering materials, for example the properties of activated carbon that desorpts when air passing therethrough is highly humidified. In other words, high air humidity will desorp volatile organic compounds VOCs from the filter and which enters into the circulating air or supply air SA as shown. Therefore, provision is made herein to convert incoming outside air OSA from deep dry air to high humidity air and to divert filter air (from filter pack 40) to exhaust. This humidity conversion and supply air diversion can be implemented in various means to accomodate any number of downstream filters: that is, downstream from the dehumidifier means D. For example, humidity conversion can be by opening a duct by-passing the desiccant wheel W, and diversion of supply air can be by a simple discharge to atmosphere. However, these conversion and diversion functions are advantageously implemented without changing the system means relationships hereinabove described by simply deactivating the desiccant wheel W and by positioning a damper means 19 to transfer filtered suppy air SA directly to the inlet duct 15 for partial recirculation with a portion thereof split off as relief air RE discharging to atmosphere at 17. Note that make-up outside air OSA enters through the deactivated desiccant wheel W without changing humidity as and when the desiccant pack therein becomes saturated and ineffective.

Filter reactivating means A is provided for simultaneously converting deep dry incoming outside air OSA to high humidity air that is mixed with return air RA by the power return section 10, for desorption of the previously saturated gas absorbent filter 40 (at least the activated carbon pack 40') and for diverting the desorped air with its acquired contaminants to the return air RA inlet duct 15.

Conversion of deep dry incoming outside air OSA to high humidity air is by means (not shown) that simply deactivates and stops the desiccant wheel W so that it saturates and ceases to function as a dehumidifier, while air continues to pass therethrough without humidity change.

Desorption of mixed oustside air OSA and return air RA is by control means (not shown) that activates the evaporative means of spray bar 36' and adjusts its degree of operation, whereby the humidity "high" is reached but not exceeded. In practice, desorption humidity is adjusted in response to humidistats in the admixed air flow through the power return section 10.

Diversion of the contaminant laden discharged supply air SA is by a damper means 19 that returns the supply air through return duct 20 and into the return air inlet duct 15. During normal operation the damper means 19 discharges through downstream sections 12–14, whereas during filter desorption operation damper 19 closes off said downstream discharge and opens through duct 20 to the return air inlet duct 15. Control means (not shown) is provided to activate and/or terminate the filter desorption process, and for example a humidistat responsive to humidity in the return air duct 20.

From the foregoing it will be understood that this system is an adsorption-desorption process wherein the desiccant in the dehumidifying section is regenerated by sorption and wherein the downstream filters are reactivated during off hours of building operation also by desorption. Accordingly said filters have a continued life and are not renewed when first saturated. Dehumidifier means D removes selected contaminants and deep drys outside air OSA to a dew point below a required dew point or the air conditioning apparatus, namely the AC cooling coils (not shown). The advantage of deep dry is to provide a condition conducive to evaporative cooling at the heat absorber section 22 of the heat-pipe means P for reducing the temperature of said outside air of increased temperature as a result of its dehumidification, by means of precise control whereby the dew point of supply air SA entering the AC conditioning apparatus does not exceed the dew point at the cooling coils thereof. This is accomplished by humidistat control so that condensation does not occur at said cooling coils, whereby heat and/or energy loss is substantially eliminated and downstream air is humidified as may be required. Further, control is by varying the degree of deep dry at the contacter C, again controlled by humidistat means (not shown). It is to be understood that the return air RA mixed with deep dry outside air OSA is discharged as supply air SA and through the filter section 11 and after which it is conditioned by the AC section 12 to be discharged as conditioned supply air SA at 16.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A co-sorption air dehumidifying and air pollutant removal system having an outside air inlet duct, a supply air duct discharging into a conditioned space, a relief air duct exhausting to atmosphere, and a return air duct receiving conditioned air from said space and having means separating return air into supply air and relief air and replacing said relief air with outside supply air, and including;

co-sorption air dehumidifier and pollutant removal means having a contactor section with a water vapor and gas adsorption desiccant means in the outside air inlet duct for adsorption of water vapor and selected pollutant gasses into said desiccant means, and having a regenerater section in the relief air duct for desorption of said water vapor and pollutant gasses into the relief air and their exhaust with said relief air to atmosphere, means for heating the relief air to a desiccant regenerating temperature and including heat-pipe means having a heat absorber section disposed in the dehumidified outside air discharged from said contacter section and having a heat rejecter section disposed in the relief air for discharge through said regenerater section of the air dehumidifier and pollutant removal means, whereby incoming outside air is dehumidified and selected pollutant gasses are removed therefrom, and a filter means downstream in the supply air duct for collecting gaseous pollutants and particulate matter from the commingled supply air and outside air.

2. The co-sorption air dehumidifying and air pollution removal system as set forth in claim 1, wherein the means for heating the relief air to desiccant regenerating temperature includes heater means following the heat-pipe means and ahead of entry of relief air through the regenerater section of the air dehumidifier and pollutant removal means.

3. The co-sorption air dehumidifying and air pollution removal system as set forth in claim 1, wherein the heat-pipe means is a first stage means for heating the relief air, and wherein the means for heating the relief air to desiccant regenerating temperature includes a second stage heat-exchanger means for the transfer of latent heat into the relief air ahead of its entry through said regenerater section from the relief air discharged through said regenerater section, and a third stage heater means ahead of entry of relief air through the regenerater section of the air dehumidifier and pollutant removal means.

4. The co-sorption air dehumidifying and air pollutant removal system as set forth in claim 1, there being a liquid evaporative means for cooling the heat rejecter section of the heat-pipe means, whereby the temperature differential with respect to the heat absorber section thereof is increased for efficiency.

5. The co-sorption air dehumidifying and air pollution removal system as set forth in claim 1, there being a liquid evaporative means for cooling the incoming outside air discharged over the heat absorber section of the heat-pipe means for decreasing the temperature of commingled return air and outside air.

6. The co-sorption air dehumidifying and air pollutant removal system as set forth in claim 1, there being a liquid evaporative means for cooling the heat rejecter section of the heat-pipe means whereby the temperature differential with respect to the heat absorber section thereof is increased for efficiency, and there being a liquid evaporative means for cooling the incoming outside air discharged over the heat absorber section of the heat-pipe means for decreasing the temperature of commingled return air and outside air.

7. A co-sorption air dehumidifying and air pollutant removal system having an outside air inlet duct, a supply air duct discharging into a conditioned space, a return air duct receiving conditioned air from said conditioned space and having means separating return air into supply air and relief air and replacing said relief air with outside supply air, and a relief air duct from the return air duct, and including;

co-sorption air dehumidifier and pollutant removal means having a contacter section with a water vapor and gas adsorption desiccant means in the outside air inlet duct for the adsorption of water vapor and selected pollutant gasses into said desiccant means, and having a regenerater section in the relief air duct for desorption of said water vapor and pollutant gasses into said relief air passed through said regeneration section, means for heating the relief air to a desiccant regenerating temperature and including heat exchanger means for the transfer of latent heat into the relief air ahead of its entry through said regenerater section from the relief air passed through said regenerater section of the air dehumidifier and pollutant removal means, and for the exhaust of relief air from said heat exchanger means, whereby incoming outside air is dehumidified and selected pollutant gasses removed from the supply air, and a filter means downstream in the supply air for collecting gaseous pollutants and particulate matter from the commingled supply air and outside air.

8. The co-sorption dehumidifying and air pollutant removal system in combination with a downstream filter means as set forth in claim 7, wherein the filter means is activated carbon for the condensation therein of pollutant gasses as a film with particulate matter carried thereby.

9. The co-sorption dehumidifying and air pollutant removal system in combination with a downstream filter means as set forth in claim 7, wherein the filter means is an activated carbon pack disposed downstream from a pre-filter means for removal of particulate matter finer than that removed upstream.

10. The co-sorption dehumidifying and air pollutant removal system in combination with a downstream filter means as set forth in claim 7, wherein the filter means is an activated carbon pack disposed between a pre-filter means for removal of particulate matter finer than that removed upstream and an after-filter means for removal of particulate matter that is finer yet than that removed by said activated carbon pack.

11. The co-sorption dehumidifying and air pollutant removal system in combination with a downstream filter means as set forth in claim 7, wherein the filter means is potassium permanganate for the condensation therein of pollutant gasses as a film with particulate matter carried thereby.

12. The co-sorption dehumidifying and air pollution removal system in combination with a downstram filter means as set forth in claim 7, wherein the filter means is a first potassium permanganate pack followed by a second activated carbon pack for the removal of pollutant gasses and particulate matter by the second pack following removal of gasses and particulate matter by the first pack.

13. A co-sorption air dehumidifying and air pollutant removal system having an outside air inlet duct, a supply air duct discharging into a conditioned space, a relief air duct exhausting to atmosphere, and a return air duct receiving conditioned air from said space and having means separating return air into supply air and relief air and replacing said relief air with outside supply air, and including;

co-sorption air dehumidifier and pollutant removal means having a contacter section with a water vapor and gas adsorption desiccant means in the ouside air inlet duct for the adsorption of water vapor and selected pollutant gasses into said desiccant means, and having a regenerater section in the relief air duct for desorption of said water vapor and pollutant gasses into said relief air and their exhaust with said relief air to atmosphere, means for heating the relief air to a desiccant regenerating temperature before passing it through said regenerater section, whereby incoming outside air is dehumdified and selected pollutant gasses are removed therefrom, a filter means downstream in the supply air for collecting gaseous pollutants and particulate matter from the commingled supply air and outside air, a conversion means for changing downstream supply air from dehumdified air to high humidity air and desorpting said gaseous pollutants collected by the filtering means, and diversion means for exhausting the desorped gaseous pollutants from said filter means.

14. The co-sorption dehumidifying and air pollutant removal system as set forth in claim 13, wherein the filter means is activated carbon for the condensation therein of pollutant gasses as a film with particulate matter carried thereby.

15. The co-sorption dehumidifying and air pollutant removal system as set forth in claim 13, wherein the filter means is a first potassium permanganate pack followed by a second activated carbon pack for the removal of pollutant gasses and particulate matter by the second pack following removal of gasses and particulate matter by the first pack.

16. The co-sorption dehumidifying and air pollutant removal system as set forth in claim 13, wherein the co-sorption air dehumidifier means is a desiccant wheel with a contacter section through which incoming outside air passes, and wherein the conversion means is a means for stopping the wheel so that it saturates and ceases to dehumidify, and there being liquid evaporative means for high humidification of said incoming outside air and discharge of supply air through the filter means for desorpting said gaseous pollutants collected thereby.

17. The co-sorption dehumidifying and air pollutant removal system as set forth in claim 13, wherein the diversion means is a damper at the downstream discharge of the filter means and a return duct therefrom to the return air duct from said air space for separation and exhaust of relief air to atmosphere.

18. The co-sorption dehumidifying and air pollutant removal system as set forth in claim 13, wherein the co-sorption air dehumidifier means is a desiccant wheel with a contacter section through which incoming outside air passes, wherein the conversion means is a means for stopping the wheel so that it saturates and ceases to dehumidify, and there being liquid evaporative means for high humidification of said incoming outside air and discharge of supply air through the filter means for desorpting said gaseous pollutants collected thereby, and wherein the diversion means is a damper at the downstream discharge of the filter means and a return duct therefrom to the return air duct from said air space for separation and exhaust of relief air to atmosphere.

19. A co-sorption air dehumidifying and air pollutant removal system having an outside air inlet duct, a supply air duct discharging through downstream air conditioning apparatus and into a conditioned space, a relief air duct exhausting to atmosphere, and a return air duct receiving conditioned air from said space, and having means separating return air into supply air and relief air and replacing said relief air with outside air, and including;

co-sorption air dehumidifier and pollutant removal means having a contacter section with a water vapor and gas adsorption desiccant means in the outside air inlet duct for deep drying incoming outside air to a dew point substantially below the dew point at said downstream air conditioning apparatus, said desiccant means being designed for the adsorption of water vapor and selected pollutant gasses, and having a regenerater section in the relief air duct for desorption of water from said water vapor and pollutant gasses and their exhaust with said relief air to atmosphere, there being a liquid evaporative means for humidifying and cooling the deep dry incoming outside air to a dew point substantially the same but lower than the dew point of said downstream apparatus and to a decreased temperature, and means for heating the relief air to a desiccant regenerating temperature, whereby incoming outside air is dehumidified and selected pollutant gasses are removed therefrom and whereby said downstream apparatus is protected against energy loss otherwise caused by condensation.

20. A co-sorption air dehumidifying and air pollutant removal system having an outside air inlet duct, a supply air duct discharging into conditioned space, a return air duct receiving conditioned air from said conditioned space and having means separating return air into supply air and relief air and replacing said relief air with outside supply air, and a relief air duct from the return air duct, and including;

co-sorption air dehumidifier and pollutant removal means having a contactor section with a water vapor and gas adsorption desiccant means in the outside air inlet duct for adsorption of water vapor and selected pollutant gasses into said desiccant means, and having a regenerater section in the relief air duct for desorption of said water vapor and pollutant gasses into the relief air passed through said regenerater section, and means for heating the relief air to a desiccant regenerating temperature and including heat exchanger means for the transfer of latent heat into the relief air ahead of its entry through said regenerater section from the relief air passed through said regenerater section of the air dehumidifier and pollutant removal means, and for the exhaust of relief air from said heat exchanger means, whereby incoming outside air is dehumidified and selected pollutant gasses are removed therefrom.

21. The co-sorption air dehumidifying and air pollutant removal system as set forth in claim 20, wherein the heat exhanger means is followed by a heater means ahead of the entry of relief air through the regenerater section of the air dehumidifier and pollutant removal means.

22. The co-sorption air dehumidifying and air pollutant removal system as set forth in claim 20, wherein the heat exhanger means is a second stage means for heating the relief air, the means for heating relief air to desiccant regenerating temperature including a first stage heat-pipe means having a heat absober section disposed in the dehumidified outside air discharged from said contacter section and having a heat rejecter section disposed in the relief air duct ahead of the heat exchanger means.

23. The co-sorption air dehumidifying and air pollutant removal system as set forth in claim 20, wherein the heat exchanger means is a second stage means for heating the relief air, the means for heating the relief air to desiccant regenerating temperature including a first stage heat-pipe means having a heat absorber section disposed in the dehumidified outside air discharged from said contacter section and having a heat rejecter section disposed in the relief air duct ahead-of the heat exchanger means, and a third stage heater means ahead of entry of relief air through the regenerater section of the air dehumidifier and pollutant removal means.

* * * * *